United States Patent [19]

Stoltz

[11] Patent Number: 5,036,631

[45] Date of Patent: Aug. 6, 1991

[54] SAND BLAST NOZZLE

[75] Inventor: Woodrow W. Stoltz, Miami, Fla.

[73] Assignee: Inventec, Inc., Miami, Fla.

[21] Appl. No.: 166,043

[22] Filed: Mar. 9, 1988

[51] Int. Cl.[5] ..... B24C 5/04

[52] U.S. Cl. ..... 51/439; 51/427

[58] Field of Search ..... 51/439, 410, 427, 319–321

[56] References Cited

U.S. PATENT DOCUMENTS

| | | | |
|---|---|---|---|
| 1,703,029 | 2/1929 | Fairchild | 51/439 |
| 2,332,281 | 10/1943 | Van der Pyl | 51/439 |
| 2,395,479 | 2/1946 | Heany | 51/439 |

FOREIGN PATENT DOCUMENTS

| | | | |
|---|---|---|---|
| 1147868 | 4/1963 | Fed. Rep. of Germany | 51/439 |
| 1158581 | 6/1958 | France | 51/439 |

*Primary Examiner*—Robert A. Rose

*Attorney, Agent, or Firm*—J. Sanchelima

[57] ABSTRACT

A nozzle for a sandblasting device having a substantially cylindrical shape with an internal longitudinal compartment covered with a hard material lining member. The compartment extends from the inlet end of the housing with a frusto-conical shape and terminates with a constant diameter at the outlet end. Clamping members are removably mounted around the hose member snuggly covering the housing.

5 Claims, 1 Drawing Sheet

SAND BLAST NOZZLE

BACKGROUND OF THE INVENTION

1. Field of the Invention

The present invention relates to nozzles, and more particularly, to such nozzles used in sand blasting equipment.

2. Description of the Related Art.

Nozzles in sand blasting equipment wear off rapidly and their frequent replacement is an expensive proposition. Several designs have been used in the past to obviate this problem with different degrees of success. However, the problem has not been effectively resolved. The industry has concentrated on designing a variety of connectors that introduce irregularities in the internal compartments of the nozzle.

Applicant believes that the closest reference corresponds to U.S. Pat. No. 1,703,029 issued to Fairchild in 1929. However, it differs from the present invention because the lining 30 disclosed in this patent consists of removable sections that create, between adjoining sections, irregularities in the surface thereby producing undesirable turbulences that eat away the lining.

Again, in Van Der Pyl's U.S. Pat. No. 2,332,281, several components, such as flanges 22 and 23, cause turbulences that eventually create irregularities in the surface of the nozzle.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a nozzle for sand blasting that includes a unitary frusto-conical inner sleeve component that provides a turbulence-free surface for the existing sand under pressure.

It is another object of this invention to provide such a nozzle that resists erosion by avoiding the creation of turbulences within the nozzle itself.

It is still another object of the invention to provide a nozzle that is inserted in the hose and aided with clamping members provide a sturdy grip that prevents leaks.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
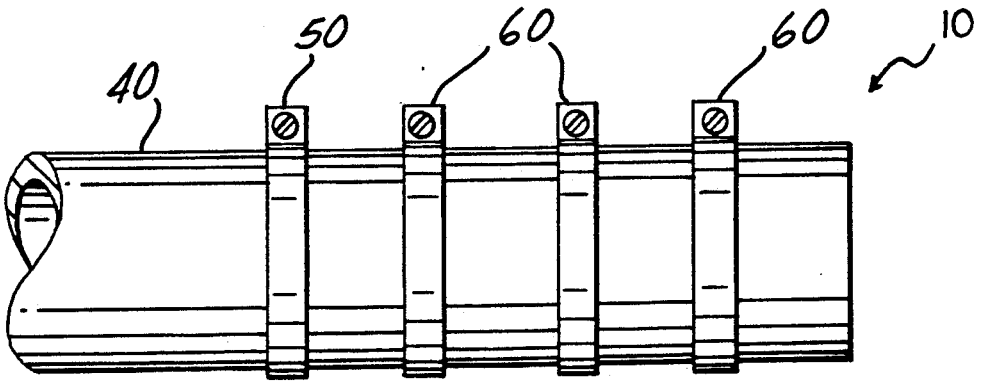
FIG. 1 is an elevational side view of a nozzle in accordance with the present invention.
Figure 2:
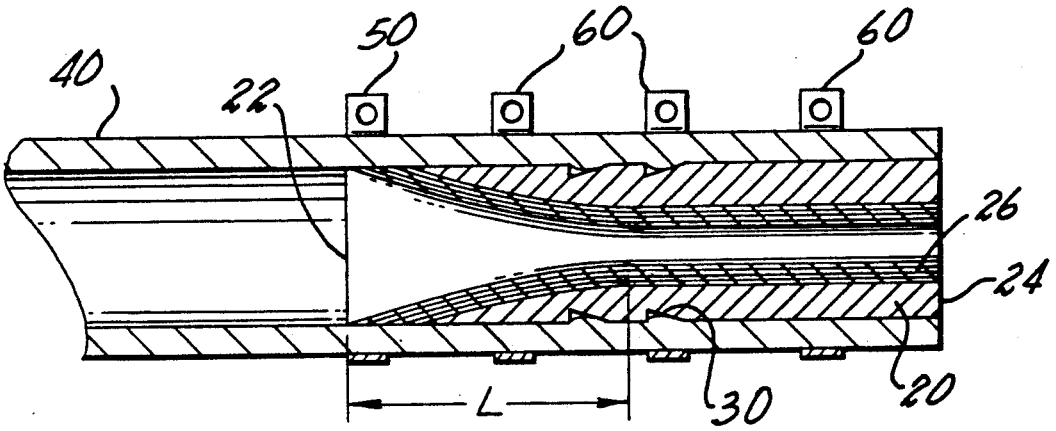
FIG. 2 represents a cross-sectional view of an embodiment of the present invention.
Figure 3:
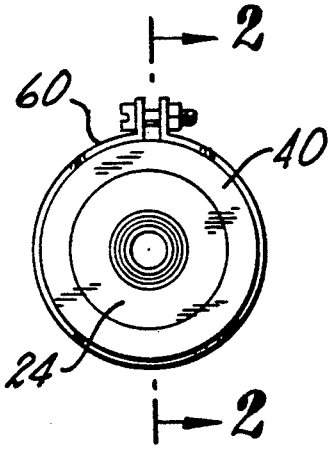
FIG. 3 is an end view of the nozzle represented in FIG. 1.

Referring now to FIGS. 1 and 2, where the present invention is generally referred to with numeral 10, it can be observed that it basically includes a nozzle housing 20 that includes several peripheral wedged shape grooves 30 that cooperatively engage with an elastic hose or conduit member 40. Nozzle housing 20 is inserted inside member 40 a sufficient distance to provide a strong grip with the aid of clamping members 50 and 60. Clamping member 50 is positioned at the edge of inlet end 22 of housing 20 so that a minimum of irregularities are produced on the internal walls of the interface between hose member 40 and inlet end 22 of housing 20. Several other clamping members 60 are disposed along the rest of hose member 40 covering housing 20 and adjacent to outlet end 24. Preferably, hose member 40 covers housing member 20 completely. Inlet end 22 starts with an inner diameter that approaches the dimensions of the outer diameter of housing 20 and this inner diameter is reduced at a continuous straight angle as it advances towards substantially the middle of nozzle 10, a distance L. In the preferred embodiment, a slight curvature is given to lining member 26 in the section defined by L and adjacent to inlet end 22. The radius of curvature is not less than 10 times L and it is intended to ensure a smooth continuity along the internal wall of lining 26. Substantially around the middle of nozzle 10, the inner diameter is maintained constant to outlet end 24. The longitudinally extending internal compartment of nozzle 10 has substantially a frusto-conical shape. Lining member 26 is made out of a hard material since it needs to resist high pressurized sand coming in contact with its walls.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A nozzle for a sandblasting device removably inserted in a pressurized hose member, comprising:

A. a substantially cylindrical and hollow housing member having inlet and outlet ends and said inlet end being snuggly inserted inside said hose member, and said housing further including a longitudinally extending internal compartment having a frusto-conical shape adjacent to said inlet end where it terminates with substantially the same diameter as the inner diameter of said hose member;

B. a lining member of hard covering the internal walls of said hollow housing;

C. a plurality of clamping members removably mounted over the section of said hose member covering said housing member and one of said clamping members being positioned adjacent to said inlet end so that the irregularities of the interface between the inner wall of said hose member and said inlet end are kept to a minimum.

2. The nozzle set forth in claim 1 wherein said internal compartment includes a section adjacent to said outlet end where its diameter is substantially constant.

3. The nozzle set forth in claim 2 wherein said housing member is completely covered by said hose member.

4. The nozzle set forth in claim 3 wherein said housing member includes a plurality of groves 30 disposed around the periphery of said housing member.

5. ,The nozzle set forth in claim 4 wherein said frusto-conical section extends substantially towards the middle of said internal compartment and the rest of the compartment has a constant diameter.

* * * * *